United States Patent [19]

Kitzmann

[11] Patent Number: 4,947,571

[45] Date of Patent: Aug. 14, 1990

[54] SELF-LOADING PISTOL

[76] Inventor: Ernst Kitzmann, Niederringel 63, 4540 Lengerich, Fed. Rep. of Germany

[21] Appl. No.: 193,709

[22] Filed: May 13, 1988

[30] Foreign Application Priority Data

May 13, 1987 [DE] Fed. Rep. of Germany ..... 3716009

[51] Int. Cl.[5] ..... F41A 9/38; F41A 9/68

[52] U.S. Cl. ..... 42/15; 42/6; 89/33.1

[58] Field of Search ..... 42/6, 15, 18, 22; 89/33.1

[56] References Cited

U.S. PATENT DOCUMENTS 45,105 11/1864 Wilson .
896,453 8/1908 St. Omer Mangle .
1,453,439 5/1923 Cedillo .
2,345,031 3/1944 Carithers .
3,060,809 10/1962 Tschumi .
3,177,601 4/1965 Meunier .
4,599,817 7/1986 Scheible .

*Primary Examiner*—Charles T. Jordan
*Assistant Examiner*—Richard W. Wendtland
*Attorney, Agent, or Firm*—Anthony A. O'Brien

[57] ABSTRACT

The invention relates to a self-loading pistol with a magazine and a device for feeding cartridges of the magazine to a cartridge chamber connected ahead of barrel (1). In this case, barrel (1) is placed in pistol frame (2, 3, 4) so that there is a space (6) under it for magazine receiving, from which a magazine (30) can be lifted by a magazine conveyor device (7) into the area of the cartridge chamber. Several magazines (30) can be fastened to one another and successively brought by magazine conveyor device (7) in the area of the cartridge chamber. Emptied magazines (30) are removed from pistol frame (2, 3, 4) by a magazine drop-out shaft (13).

23 Claims, 4 Drawing Sheets

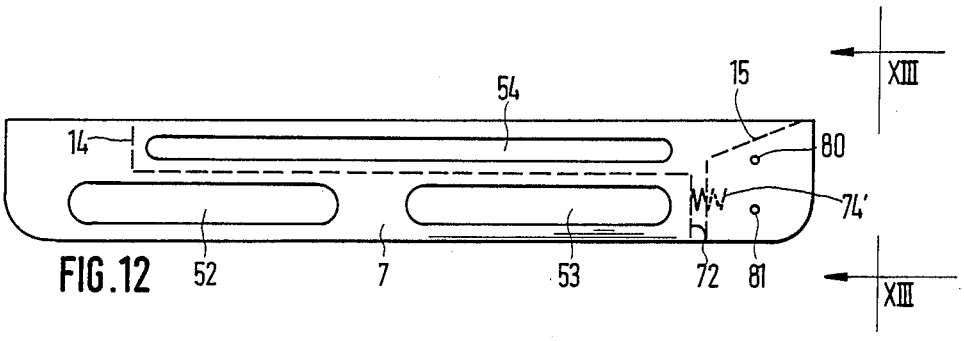
FIG.12
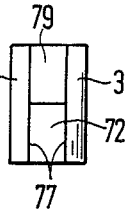
FIG.13
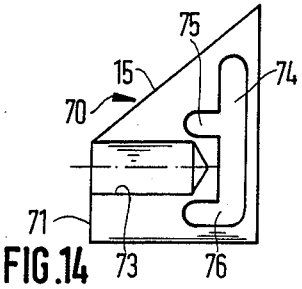
FIG.14
FIG.15
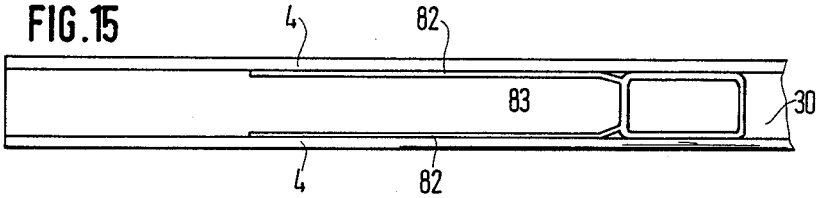
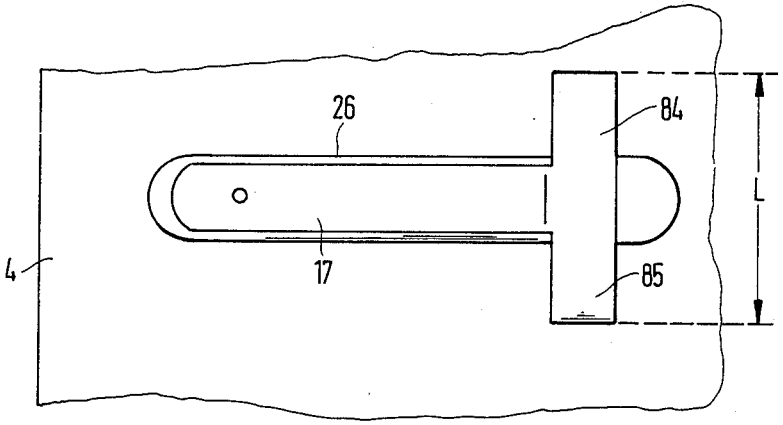
FIG.16

SELF-LOADING PISTOL

The invention relates to a self-loading pistol provided with a magazine and a feeding device for feeding cartridges to a pistol chamber.

With known self-loading pistols of this type there is a problem that because of their design as well as the structure and guiding of their magazines they are relatively large and therefore unwieldy. This results especially in conventional pistols of this type not being able to be carried by their users unnoticed.

Another substantial advantage consists in the fact that the present self-loading pistol becomes front-heavy by the arrangement of the magazine under the barrel and the great weight of the magazine, which results in a great precision or accuracy of the pistol during firing.

Therefore the object of this invention is to provide a self-loading pistol which is so small and compact that it can be carried by a user unnoticed.

A further advantage of this invention consists in the fact that because of a new type of barrel fastening and also a new type of magazine configuration and magazine guide, it can be so small, flat and compact that it can easily be carried by a user unobtrusively for example, in a briefcase or in a special coat inside pocket or the like. For example, it is easily possible to make a self-loading pistol according to the invention which has dimensions of approximately 300 mm×190 mm×14 mm.

Because of its compact and flat design this self-loading pistol is thought of especially for protection of official personnel. For example, this self-loading pistol is excellently suitable as equipment for flight crews and their accompanying personnel, if 22 LB ammunition is used with fragmenting bullets. Such bullets have the property that on hitting the aircraft walls they burst and do not shatter the walls.

Another advantage of the invention consists in the fact that the magazines designed and carried in this novel way can be handled in a particularly simple way by a special magazine conveyor device.

The novel type magazine arrangement makes possible the successive firing of 5×20 rounds, which is especially advantageous with the small dimensions.

Another advantage consists in the fact that the self-loading pistol according to the invention because of its simple and clear design can be made and maintained in an exceptionally simple and cost-favorable way.

Other preferred and advantageous configurations of the invention will become apparent from the following description with reference to the drawings.

BRIEF DESCRIPTION OF THE DRAWINGS

FIGS. 12 to 16 are further developments of the invention.

Figures 1, 2, 3, 4, 5, 6:
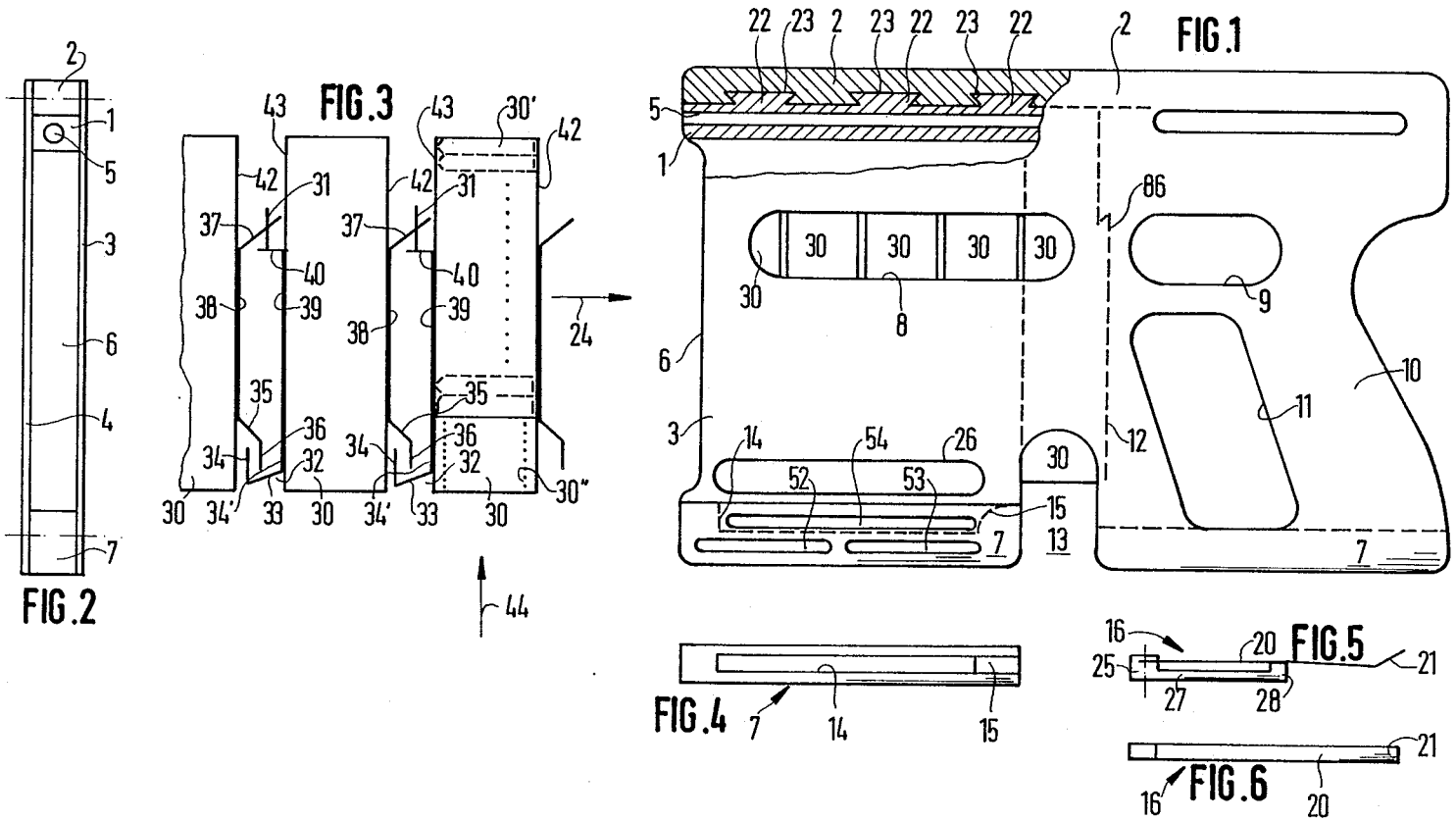
FIG. 1, partially in section, is a side view of the self-loading pistol, and from this representation it is possible to gather especially the type of fastening of the barrel and the type of the magazine guide.
FIG. 2, is a side view of the self-loading pistol of FIG. 1 from the magazine slide-in side.
FIG. 3, is diagrammatic representation for explaining the way in which the magazines can be fastened to one another.
FIG. 4 is a top plan view showing details of the magazine conveyor device.
FIG. 5 is a plan view showing details of the magazine conveyor device.
FIG. 6 is a plan view showing other details of the magazine conveyor device.

It can be gathered from FIGS. 1 and 2 that this self-loading pistol preferably is made approximately rectangular and basically consists of an upper frame part 2, a corresponding lower frame part 7 and two side walls 3, 4. In this case, side walls 3, 4 are preferably screwed to upper frame part 2 and lower frame part 7 in the way diagrammatically represented in FIG. 2 with suitable screws. The rear area of the frame parts 2 and 7 define a pistol handle 10 having a trigger opening 9 and a fingers opening 10 as shown in FIG. 1. It can be seen in FIG. 1 that barrel 1 with its bore 5 is fastened on the inwardly turned lower side of the front area of upper frame part 2, which serves a barrel mounting support. Preferably fastening of barrel 1 on barrel mounting support 2 takes place with the help of dovetail projections 22, which engage in corresponding dovetail recesses 23, and said projections 22 and recesses 23 are provided on the sides of barrel 1 and barrel mounting support 2 that are turned toward one another. This type of fastening of barrel 1 on barrel mounting support 2 therefore is especially advantageous, since, during assembly of this self-loading pistol, barrel 1, for example, after fastening of side wall 4 on barrel mounting support 2, may simply be shoved into barrel mounting support 2 from the side turned away from side wall 4, without special and complicated fastening operations being necessary. But it is also possible to fasten barrel 1 in other ways on barrel mounting support 2 or on side walls 3, 4.

In the front area of lower frame part 7, which contains the magazine conveyor device, suitable devices are provided, with whose help the magazines diagrammatically represented in FIG. 3, which in the direction of arrow 24 are conveyed into a magazine receiving opening 6 position suitable for firing. This will be explained below in greater detail. Magazine receiving opening 6, as appears particularly in FIG. 2, is determined by the inside surfaces of barrel 1, the magazine conveyor device or the front area of lower frame part 7 and side walls 3, 4.

An opening 8 for checking the magazine can be provided below barrel 1, preferably in at least one of side walls 3, 4. It is possible to see through opening 8 how many magazines are in what positions behind magazine receiving opening 6.

Magazine receiving opening 6 ends on the inside of this self-loading pistol at a magazine contact surface 12, which preferably is formed by a wall or plate extending perpendicular to side walls 3, 4 and perpendicular to bore 5 of barrel 1, which wall or plate is fastened to side walls 3, 4, for example, by screws.

In connection with FIG. 3, the design of magazine 30 and the way of fastening several magazines 30 to one another is now explained. Each magazine 30 consists of a boxlike known in the art series of cartridges 30' acted on by diagrammatically represented spring device 30'' are contained which successively are fed to barrel 5 in a firing operation. Each magazine 30 exhibits a rear surface 42, which is shoved first into magazine receiving opening 6, and which is turned toward contact surface 12 during the firing operation. A front surface 43, opposite rear surface 42, the magazine exhibits a guide pin 31, at a distance from this front surface 43, a pin, which on its end turned away from the upper magazine end, is fastened to a pin supporting surface 40 so that it is kept at a distance from front surface 43 on magazine 30. In this case, pin supporting surface 40 is fastened to front surface 43 in the upper half of front surface 43 of magazine 30. To the lower end area of front surface 43 of magazine 30 is fastened an angular part 33, which is bent so that in a converging direction it runs to the extension of the lower edge of magazine 30. Consequently, in the way shown in FIG. 3, between angular part 33 and the lower end area of front surface 43 a stop notch 32 is formed, whose function will be explained in greater detail below. To the free end of angular part 33 is fastened a locking surface 34, which is at a distance from front surface 43 of magazine 30 and preferably runs parallel to it for a preset distance in the direction of the upper end of magazine 30. Preferably pin supporting surface 40, angular part 33 and locking surface 34 constitute angular parts of a material strip 39, which preferably consists of a metal and is fastened to front surface 43 of magazine 30.

To rear surface 42 of each magazine 30 is fastened in the upper half an angular stop part 37, which exhibits a through bore (not further indicated), in which guide pin 31 of an adjacent magazine 30 can engage. In the lower end area, there is fastened to rear surface 42 a locking part 36, which is at a distance from rear surface 42 and is dimensioned so it engages in the gap of an adjacent magazine 30, which is enclosed by locking surface 34, angular part 33 and the area of metal strip 39 opposite locking surface 34. Preferably angular stop part 37 and locking part 36 also constitute angular parts of a material strip or metal strip 35, 38, which is fastened to rear surface 42 of magazine 30. Angular stop part 37 of the magazine 30, brought into firing position, engages in a recess of contact surface 12, thus magazines 30 are prevented from being pulled out of magazine receiving opening 6 opposite the direction of arrow 24. Preferably angular stop part 37 cradles shoulder 86 (see FIGS. 8–10) projecting obliquely downward from contact surface 12.

It becomes possible by said elements 31 to 37 for several magazines 30 to be placed friction-locked on one another, and between adjacent magazines 30, 30 in each case guide pin 31 of one magazine engages in the hole of angular stop part 37 of the other magazine and engages from behind locking part 36 of locking surface 34, if magazines 30, 30 are lined up with one another with respect to their longitudinal extension. As a result, with the movement of the first magazine 30 in the direction of arrow 24 (FIG. 3), all following magazines 30 follow this movement. This means that in case of arming the self-loading pistol magazines 30, 30, fastened to one another in the way shown in FIG. 3, are successively fed into magazine receiving opening 6 until the foremost or first fed magazine 30 with angular stop part 37 and locking part 36 rests against contact surface 12. Fastening of magazines 30 to one another takes place because in each case the front magazine is moved from below in the direction of arrow 44 so that guide pin 31 of the respective front magazine 30 engages in the hole of angular stop part 37 of the respective following magazine and locking part 36 of the respective following magazine engages from behind locking surface 34 of the respective front magazine.

With the above described magazine fastening release or separation of a front magazine 30 from a following magazine 30 opposite the direction of arrow 44 is possible at all times. In this way, explained more in detail below, magazines 30 are unloaded after removal of the bullets has taken place and after the necessary release by magazine drop-out shaft 13 of this self-loading pistol.

A more detailed explanation will be given below in connection with FIGS. 1, 4 to 6 and 7 to 11 of the magazine conveyor device, whose function and object consists especially in each case in shoving the magazine that is most forward in magazine receiving opening 6 upward along contact surface 12 so that it takes a position, in which sequentially cartridges of the magazine can be fed by the lock (not shown) of the pistol into the cartridge chamber of barrel 1.

The magazine conveyor device is in the area of lower frame part 7, which is below magazine receiving opening 6 between side walls 3 and 4. As can be seen especially in FIG. 4 which shows a top view of the side turned toward magazine receiving opening 6 of frame part 7, and as can be seen from the perspective representation of FIG. 7, which shows in an exploded view side walls 3, 4 connected to frame part 7 as well as other elements of magazine conveyor device, in frame part 7 there is a longitudinal slot 14, whose open end is turned toward magazine receiving opening 6. Longitudinal slot 14 is so dimensioned as to receive a slide part 16 which as seen particularly in FIG. 5, 6 and 7, can be mounted to slide. On one end of longitudinal groove 14 there is a ramp-shaped bend 15, whose function will be explained in greater detail below, which extends in an arch from the bottom of longitudinal groove 14 to the inside surface of frame part 7, and bend 15 runs up to magazine receiving opening 6. Slide part 16 basically consists of a holding block 25 and a magazine lifting device fastened therein, which preferably exhibits the form of a flat spring 20, whose one end is fastened in holding block 25 so that lifting spring 20 extends in the longitudinal direction of frame part 7 in longitudinal groove 14, when slide part 16 is disposed in longitudinal groove 14. The upwardly pointing surface of holding block 25 preferably in the plane of the upper surface of frame part 7 is in this condition. Free end 21 of lifting spring 20 is bent or angular in the direction of magazine receiving opening 6.

Preferably, lifting spring 20 is fastened between two parts of holding block 15, so that the parts are screwed to one another, and the one end of lifting spring 20 is between said parts.

Flat spring 20 rests normally, if its free end 21 is not lifted by ramp 15, on a support area 28, which is at a distance from holding block 25 in the direction of contact surface 12. Preferably support block 28 is fastened to holding block 25 by a spacer 27, which can slide on the bottom of longitudinal groove 14.

Figure 7:
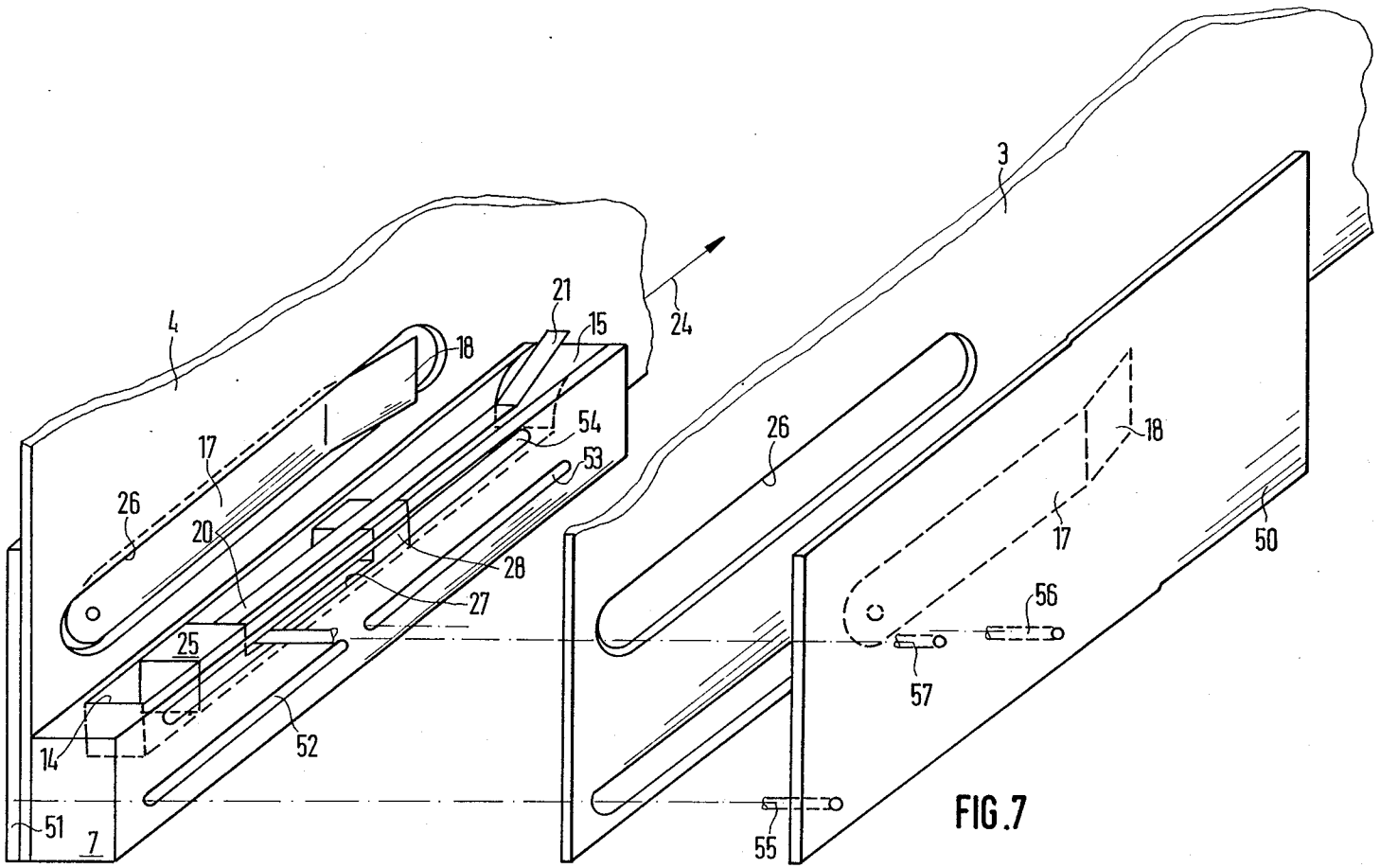
FIG. 7 is an exploded perspective view of details of the magazine conveyor device.

Slide part 16 can slide in longitudinal groove 14 between a first position, in which free end area 21 is lifted by ramp-shaped part 15, and a second position, in which free end area 21 is not lifted by ramp-shaped part 15. Preferably, sliding of slide part 16 takes place in longitudinal groove 14 by at least one bolt 57 passed through of spacer 27 and below flat spring 20, a bolt which according to FIG. 7 is guided through an oblong recess 54 of frame part 7 extending in the longitudinal direction. Preferably a slide plate 50, 51, which is fastened in the free end of bolt 57, is provided on each outer side of side walls 3, 4. By sliding of slide plates 50, 51 in the direction of arrow 24 and opposite this direction, slide part 16 can be moved back and forth between said two positions. Bolt 57 runs through the recesses (not shown) allowing said sliding of side walls 3, 4. Side springs 17, 17, opposite one another, when covering the slide plates, are fastened to the inner sides of slide plates 50, 51; such springs which extend in the longitudinal direction of longitudinal groove 14 and whose free end areas, which are turned toward ramp 15, are guided inwardly by recesses 26, 26 of side walls 3, 4 running in said longitudinal direction. The ends of flat side springs 17, 17 turned away from the free end area in each case are fastened, preferably riveted to slide plates 50, 51. Front ends 18, 18 of the free end areas of side springs 17, 17 are suitably slightly inward bent towards one another and can be spread apart so that a magazine 30 can be shoved through between them in the direction of arrow 24. In addition, said ends 18 are elastic toward one another so that they can engage in the area between locking surface 34 and an impact surface 34' of a magazine 30 and in the movement of side springs 17, 17 together with slide plates 50, 51 in the direction of arrow 24 on impact surface 34', so that magazine 30 is then carried along in the direction of arrow 24. Preferably sheet metal strip 39 serves as an impact surface. To assure a reliable, parallel and tilt-free conveying of magazines 30, ends 18, 18 of side springs 17, 17 are suitably so high that they are applied in the area of the middle of magazines 30 or of the middle between angular part 33 and pin holding surface 40. The end positions of slide plates 50, 51 are preferably so determined that at least one bolt or the like, which is fastened to at least one slide plate, engages in another oblong recess of at least one side wall 3 or 4, or by a recess through one of side walls 3, 4 engages in a another oblong recess of frame part 7, and said other recesses in each case also extend in the longitudinal extension of frame part 7 and the one end of the other recess corresponds to a first position and the other end of the other recess corresponds to a second position. Especially preferably two bolts 56, 55 run between slide plates 50, 51, bolts whose one ends are fastened to one slide plate 50 and whose other ends are fastened to the other slide plate 51, by other similar recesses 52, 53, which preferably are below recess 54, placed behind one another in the slide direction of slide plates 50, 51, and by a recess in side walls 3, 4. In this arrangement according to FIG. 7, the front ends of recesses 52 or 53 correspond to the second position, while the back ends of these recesses correspond to the first position.

The function of the magazine conveyor device will be explained below in greater detail in connection with FIGS. 8 to 11. In this case, it is assumed that already five magazines 30-1, 30-2, 30-3, 30-4 and 30-5 have been shoved through magazine receiving opening 6 and that magazine 30-1, shoved in first rests on contact surface 12 and has been raised into the position necessary for removal and firing of the bullets, in which angular stop part 37 engages behind already mentioned oblique shoulder 86 on contact surface 12. In this position free end area 21—lifted by ramp-shaped part 15 in the front position of slide part 16—of flat or lifting spring 20 engages in already described stop notch 32 of magazine 30-1. Further, ends 18, 18 of side springs 17, 17 rest on impact surface 34 of magazine 30-1, if slide plates 50, 51 are in the first position. Magazines 30-2 to 30-5 rest with their lower ends on the edge areas of longitudinal groove 14 of frame part 7.

Figure 8:
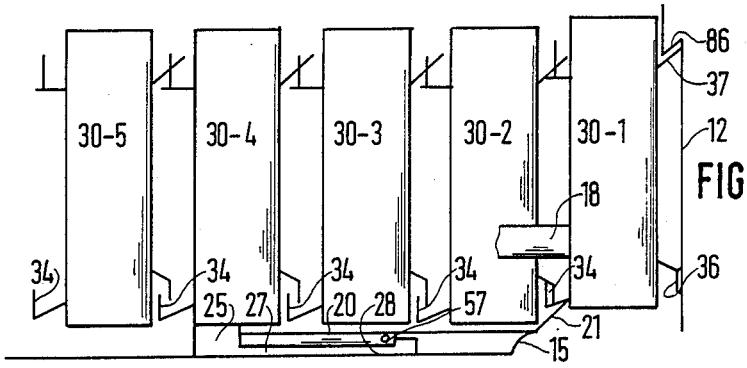
FIGS. 8 to 11 are successive diagrammatic representations for explaining the magazine guide.
Figure 9:
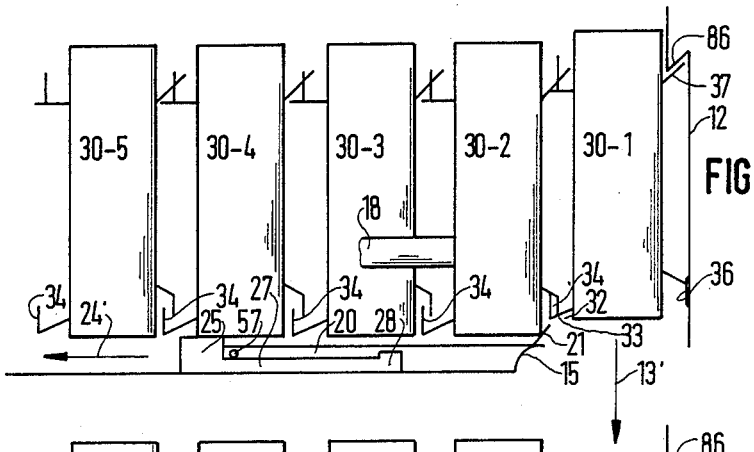
Figure 10:
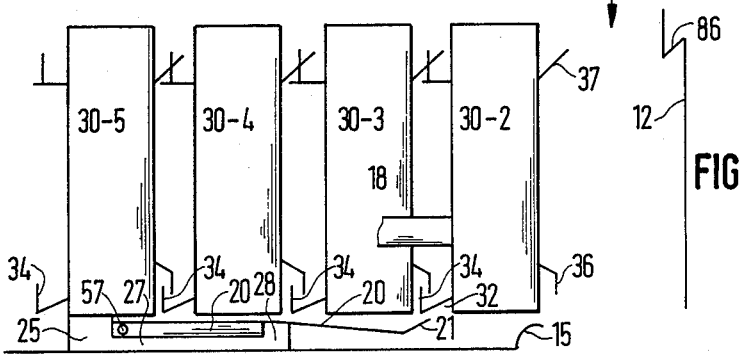

If slide plates 50, 51, after emptying of magazine 30-1, are shoved from the first position represented in FIG. 8, in the direction of arrow 24' of FIG. 9, ends 18, 18 of side springs 17, 17 are first removed from impact surface 34' of magazine 30-1 (in the direction of arrow 24'). Not until ends 18, 18 spring together behind impact surfaces 34' of magazine 30-2, is bolt 57 applied on holding block 25 so that slide part 16 is moved with time delay in the direction of arrow 24', until free end area 21 of lifting spring 20 has been sunk on ramp-shaped part 15 so that the free end of lifting spring 20 leaves stop notch 32, so that magazine 30-1 drops through the shaft in the direction of arrow 13'. This position corresponds to the second position of slide plate 50, 51.

Figure 11:
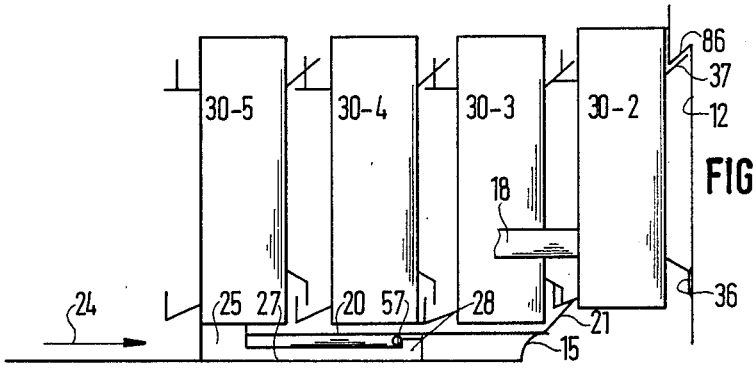

Subsequently, slide plates 50, 51 are again shoved in the direction of arrow 24 (FIG. 11), and magazine 30-2 shoved in the direction of arrow 24 of FIG. 11 to contact surface 12. Bolt 57 is applied on support block 18 with time delay, and then lifting spring 20 is shoved forward (direction 24) and front end area 21 is lifted onto ramp-shaped part 15. This means that in the first position of slide plates 50, 51, magazine 30-2 is lifted so that its angular stop part 37 engages behind oblique shoulder 86.

When the other magazines 30-3 to 30-5 are conveyed, the processes already explained in connection with FIGS. 8 to 11 are repeated.

Generally speaking, the magazine conveyor device is so made that with the movement of slide plates 50,51 from the second to the first position, ends 18, 18 of side springs 17, 17 are applied on a front magazine to convey it to contact surface 12 and, shortly before reaching of the first position, lifting spring 20 or its end area 21 is lifted onto ramp 15, to lift the front magazine into the desired position on contact surface 12. With the movement of slide plates 50, 51 from the first to the second position, while slide part 16 or lifting spring 20 first stays in the above-mentioned position until bolt 57 arrives at holding block 25 from support block 18, side springs 17, 17 are guided over the following magazine until they spring together and engage impact surface 34' from behind. At this point, bolt 57 is applied on holding block 25, so that lifting spring 20 is retracted with slide part 16 for release of the front magazine until slide plates 50, 51 reach the second position.

A further development of the invention can be seen in FIGS. 12 and 14, by which care is taken that with interruption of firing and with already cocked trigger, the magazine, from which the cartridges are just being removed, can be lowered along contact surface 12 by a preset distance, that the cartridge in front of the retracted lock is lowered from the firing position and the lock is again closed or can be moved forward. For this purpose, a block 70 exhibiting ramp 15 is provided on frame part 7. Block 70 can be lowered from a first, upper position, in which ramp 15 is placed so that it can perform the described function, into a lower position. With the lowering process, free end 21 of lifting spring 20, resting on ramp 15 during firing, is also lowered. This results in said magazine being carried a preset distance downward along contact surface 12, but it continues to be held by free end 21 of lifting spring 20 (engagement of the free end in stop notch 32). Now the lock can be locked. With resumption of the firing sequence the trigger of the weapon is cocked (retraction of the mass of the lock), and block 70 is lifted into its upper position and stopped in it. Thus, the upper cartridge of the also lifted magazine is brought again into firing position.

Preferably, block 70, exhibiting ramp 15, consists of a block that can slide between an upper and lower position in a recess 77 of frame part 7, a block which exhibits a surface 71, which, in this sliding, runs along a slide surface 72 of frame part 7, which runs parallel to contact surface 12 and limits recess 77 on the side turned away from that of contact surface 12. Laterally, recess 77 is limited by walls 78, 79 of frame part 7 projecting beyond slide surface 72, between which block 70 can slide. Said block exhibits a bore 73, in which a coil spring 74' is placed, which seeks to force block 70 away from slide surface 72. Further, in part 14, running parallel to slide surface 12 is a through groove 74, into which two crosswise grooves 75, 76 come out, which are at a distance from one another. Corresponding to this distance, pins 80, 81, which go through crosswise grooves 75, 76, run between walls 78, 79. In the upper position of block 70, pins 80, 81 rest on the ends of crosswise grooves 80, 81. For moving into the lower position, block 70 is moved against the force of spring 74, until it rests on slide surface 72. In this condition, pins 80, 81 are aligned with through groove 74 so that block 70 can be moved along slide surface 72 into the lower position, in which top pin 80 rests on the upper end of through groove 74. It is dimensioned so that its upper end ends above groove 75 and its lower end ends on the lower edge of groove 76.

A further development of the invention can be seen in FIG. 15, in which at least one, but preferably two, opposite retaining springs 82 are provided, which, in the repeated movements of slide plates 50, 51 and the elements linked thereto, keep the magazine, resting on contact surface 12, from being moved with the slide plates or the elements in the direction of receiving opening 6. Retaining springs 82 exhibit the form of flat springs, which are fastened to the inside surface of side walls 3,4, so that their free ends 83, which elastically project into the space between side walls 3, 4, are supported on said magazine and keep it from said movement. In the conveying of a magazine to contact surface 12 ends 83 are elastically forced away from one another so that the magazine can go between ends 83. When the magazine rests on contact surface 12, ends 83 spring inward behind the magazine to rest on it.

Finally, in FIG. 16 a configuration of the invention is represented, in which the ends of side springs 17, which are fastened to slide plates 50 or 51, projecting through recesses 26 of side walls 3, 4, are so configured that exhibit areas 84, 85 proejcting up and/or down, which areas run perpendicular to the longitudinal extension of side springs 17. In this way the free end edges of areas 84, 85 are applied over a relatively large length L on the magazines to convey them.

I claim:

1. A self-loading pistol including:

a frame having a rearward pistol portion defining a pistol handle (10) and a forward pistol portion including upper and lower frame parts (2 and 7) and spaced parallel side walls (3) and (3) extending between said frame parts (2 and 7), a barrel (1) attached to said upper part frame (2), a magazine receiving space (6) defined by a lower surface of said barrel (1) and an upper surface of said lower frame part (7) and between said side walls (3) and (4), and by a contact surface (12) on said pistol handle (10), a plurality of magazines (30) adapted to be disposed in said space (6) and arranged next to each other and parallel to a longitudinal direction defined by said barrel (1), each magazine including a plurality of cartridges (30') arranged parallel to said longitudinal direction and spring means (30'') biasing said cartridges (30') for successive movement to said barrel (1), fastening means between adjacent sides (42,43) of said magazines (30) for unitary movement thereof along the longitudinal direction, each magazine (30) having a rear surface (42) and a front surface (43), each magazine (30) having its rear surface (42) facing said contact surface (12) and its front surface (43) facing the rear surface (42) of the next magazine (30-2), the rear end of said magazine receiving space adjacent said contact strip (12) having a top portion defining a cartridge chamber communicating with the barrel bore (5) and a lower portion defining a magazine ejection cavity (13) through which an empty magazine is discharged, a magazine conveyor device on said lower frame part (7) for moving said plurality of magazines (30) along the longitudinal direction toward said contact surface (12), said conveyor device having slide means (16) being manually reciprocated relative to said lower frame part (2), said conveyor device including a flat spring (20) having a free end (21) for lifting each magazine (30) into said cartridge chamber as it slides against contact surface (12), a stop element (86) on said contact strip (12) adapted to define the limit of lifting movement of said each magazine (30-1) into said cartridge chamber, said free end (21) engaging said stop element (86) to retain said each magazine (30-1) in firing position until released by said free end (21) as it moved away from said element (86) whereby said each magazine (30-1) permitted to discharge through the ejection cavity (13).

2. Pistol according to claim 1, wherein upper frame part (2) and barrel (1) each has a square cross section.

3. Pistol according to claim 1, wherein the surfaces of upper frame part (2) and barrel (1) rest on one another and have respectively by elevations (22) forming dovetails and complementary recesses (23) whereby the upper frame part (2) is securely connected to the barrel (1).

4. Pistol according to claim 1, wherein the lower frame part has (7) a rectangular cross section.

5. Pistol according to claim 4, wherein said magazine conveyor device is movable between a first position and a second position, wherein said magazine conveyor device during movement from the second position to the first position, carries a magazine (30) to contact surface (12) so that magazine (30), on reaching the first position, rests on the contact surface, and wherein shortly before reaching the first position, magazine (30) is lifted by said free end (21) of said magazine conveyor device sliding along contact surface (12) into the area of the cartridge chamber.

6. Pistol according to claim 5, wherein the slide means (16) includes at least one slide plate (50, 51), held slidably on the outside of side wall (3-4) between the first position and the second position, wherein a flat spring (17), projecting obliquely through a recess (26)

of side wall (3-4) into space (6) in the direction of contact surface (12), is fastened, with its one end, to slide plate (50, 51), wherein the other end of flat spring (17), in the movement from the second to the first position, is applied to the front side of a magazine (30) turned toward it, to convey the magazine to contact surface (12), and wherein flat spring (17), in the movement from the first to the second position, laterally slides past a magazine (30) elastically springing outward.

7. Pistol according to claim 6, wherein an oblong recess (52, 53) is disposed in said lower frame part (7) parallel to the longitudinal direction and at least one bolt (55, 56) extends through said recess (52, 53), said slide walls (3, 4) and said slide plate (50, 51) to define the first and second position of said slide plate (50, 51), and wherein each end of the oblong recess (52, 53) is assigned to one of the first and second positions.

8. Pistol according to claim 6, wherein a slide plate (50, 51) is disposed on the outside surface of each side wall (3, 4), wherein slide plates (50, 51) are opposite one another, wherein recess (52, 53) goes through lower frame part (7), and wherein the bolt connects the two slide plates (50, 51) to one another.

9. Pistol according to claim 8, wherein two oblong recess (52, 53) are disposed behind one another in frame part 7 in the longitudinal direction and wherein a bolt (55, 56), fastened to slide plate (50, 51), engages in each oblong recess (52, 53).

10. Pistol according to claim 9, wherein each magazine (30-2), on its rear side (42) first introduced into space (6) has a first fastening device (37, 36) secureable to a second fastening device (31, 34) provided on front side (43) of the respective preceding magazine (30-2) last introduced into space (6), wherein a separation of preceding magazine 30-2 from the following magazine (30-1) and the delivery of preceding magazine (30-1) through ejection cavity (13), after release of magazine (30-1) by magazine conveyor device, is accomplished.

11. Pistol according to claim 10, wherein fastening of preceding magazine (30-1) and following magazine (30-2) to one another is effected when the first and second fastening devices (37, 36) and (31, 34) are meshed by ejection cavity (13) opposite the delivery direction of a magazine.

12. Pistol according to claim 11, wherein the first fastening device consists of an angular stop part (37), which is applied in the upper half of said front side (42) so that it stretches away therefrom and of a locking part (36), which is placed on the lower half of said front side (42) so that it runs approximately parallel to said front side (42) and is at a distance from it, wherein the second fastening device consists of a guide pin (31) disposed in a hole of angular stop part (37), a pin that runs approximately parallel to said front side (43), is at a distance therefrom and is fastened to a pin holding surface (40) connected to said front side (43), and of a locking surface (34), which is at a distance from said front side (43), runs approximately parallel thereto so as engage from behind locking part (36).

13. Pistol according to claim 12, wherein angular stop part (37) runs diverging obliquely upward from said front side (42) and wherein angular stop part (37) engages from behind said stop element (86) on contact surface (12), when magazine (30-1) is lifted onto the contact surface in the area of the cartridge chamber by magazine conveyor device, so that a movement of preceding magazine (30-1) opposite slide-in direction (24) is prevented.

14. Pistol according to claim 13, wherein stop element (86) is a shoulder made complementary to angular stop part (37), which extends outward from contact surface (12).

15. Pistol according to claim 14, wherein an angular part (33) connecting said locking surface (34) to said front side (43) and defining a stop notch (32) to engage the free end (21) of flat spring (20) which end area (21) of lifting spring (20) can engage.

16. Pistol according to claim 15, wherein pin holding surface (40), angular part (33) and locking surface (44) are formed from a material strip, which is fastened to second front surface (43).

17. Pistol according to claim 16, angular stop part (37) and locking part (36) are formed from another material strip, which is fastened to said front surface (42).

18. Pistol according to claim 1, wherein the upper and lower end surface of each magazine (30) can slide on the lower surface of barrel (1) and on upper surface areas of said frame part (7) for guiding into space (6).

19. Pistol according to claim 18, wherein aramp (15) on said lower frame part (7) is engaged by said free end; (50, 51) is lifted onto a ramp-shaped bend (15) of lower frame (50, 51) so that on reaching the first position magazine (30), conveyed to contact surface (12), is lifted by free end (21) into the area of the cartridge chamber.

20. Pistol according to claim 19, wherein slide part (16) slides in a longitudinal groove (14) of frame part (7) and exhibits a holding block (25) for lifting spring (20) and a support part (28), at a distance from one another in the longitudinal direction, which are fastened to a spacer (27) that can be inserted in longitudinal groove (14), wherein between holding block (25) and support part (28) a bolt (57) runs through, which is fastened to slide plate (50, 51) and runs through a recess (54) of frame part (7) running in the longitudinal direction, and wherein the time-shifted movement of slide part (16) in relation to slide plate (50, 51) takes place by applying bolt (54) to holding block (25) or support part (28).

21. Pistol according to claim 20, ramp (15) is provided on a part (70), which can be moved in a recess (77) of frame part (7) between an upper position, in which end (21) of lifting spring (20) on ramp-shaped bend (15) lifts magazine (30) into the area of the cartridge chamber, and a lower position, in which end (21) of lifting spring (20) is lowered so far that magazine (30) is lowered from the area of cartridge chamber (5).

22. Pistol according to claim 21, wherein opposite retaining springs (82), extending in the longitudinal direction, are fastened to the inside surfaces of side walls (3-4) above lower frame part (7) and have ends (83), turned toward contact surface (12), in a movement of slide plate spring away from one another from the second position to the first position, to allow a conveyed magazine (30) to pass and in applying magazine (30) to contact surface (12) to spring inward and come to rest on the side of magazine (30) turned away from contact surface (12), so that a movement of the same in the direction of receiving opening (6) is prevented.

23. Pistol according to claim 22, wherein the other ends of side spring (17) includes at least one area (84, 85) running perpendicular to the longitudinal extension of side springs (17) over their thickness, an area whose free end edge rests on magazine (30) during conveying.

* * * * *